US007552748B2

(12) United States Patent
Dean

(10) Patent No.: US 7,552,748 B2
(45) Date of Patent: Jun. 30, 2009

(54) DEVICE FOR BENDING WIRE OF A WIRE FENCE

(76) Inventor: Tony Dean, 125 Ridings Rd., Chesnee, SC (US) 29323

( * ) Notice: Subject to any disclaimer, the term of this patent is extended or adjusted under 35 U.S.C. 154(b) by 157 days.

(21) Appl. No.: 11/334,273

(22) Filed: Jan. 18, 2006

(65) Prior Publication Data

US 2007/0163670 A1 Jul. 19, 2007

(51) Int. Cl.
*B21F 1/00* (2006.01)
*H01R 43/033* (2006.01)

(52) U.S. Cl. ..... 140/106; 140/123

(58) Field of Classification Search ..... 140/106, 140/123, 123.5; 7/117, 143; 81/20, 426, 81/418–420, 424.5; 72/409.01, 409.18, 414, 72/415

See application file for complete search history.

(56) References Cited

U.S. PATENT DOCUMENTS 129,506 A * 7/1872 Woodville ..... 81/426
491,393 A * 2/1893 Watkins et al. ..... 294/3
526,766 A * 10/1894 Williams ..... 29/243.56
1,887,732 A * 11/1932 Pagel et al. ..... 140/152
2,700,910 A * 2/1955 Van Niel ..... 29/268
2,755,692 A * 7/1956 Wallshein ..... 72/390.5
3,364,724 A * 1/1968 Schmidt ..... 72/409.18
4,336,832 A * 6/1982 Poulos ..... 81/20
5,084,935 A * 2/1992 Kalthoff ..... 7/132
5,545,168 A * 8/1996 Burke ..... 140/106
6,354,174 B1 3/2002 Korwin

* cited by examiner

*Primary Examiner*—Dana Ross
*Assistant Examiner*—Teresa Bonk
(74) *Attorney, Agent, or Firm*—J. Bennett Mullinax, LLC

(57) ABSTRACT

An apparatus for bending wire of a wire fence so as to increase the tension thereof is provided. The apparatus includes a first member that has a female portion. The female portion has a recess surface, that may be flat, located between a first projection and a second projection. The recess surface, first projection and second projection at least partially define a recess. A second member is in pivotable engagement with the first member. The second member has a male portion with a tip. The tip of the male portion may be configured to move into and out of the recess of the first member so as to bend wire of a wire fence therein.

15 Claims, 5 Drawing Sheets

DEVICE FOR BENDING WIRE OF A WIRE FENCE

FIELD OF THE INVENTION

The present invention relates generally to devices that are used to bend wire of a wire fence. More particularly, the present application involves a device for bending wire of a wire fence in order to tighten or increase the tension, and hence reduce sagging, of the wire fence during installation and/or repair.

BACKGROUND

Farmers and property owners commonly install wire fence in order to demarcate the boundary of property or to confine animals. Installation of a wire fence, especially over rough terrain, generally requires the step of tightening the wire after it is secured to a post. For example, when a section of wire fence is positioned up a hill the top of the wire fence is generally tight while the bottom of the wire fence is loose.

Common practice is to tighten the wire of the fence with the use of pliers, screwdrivers, and/or claw hammers. In this regard, the installer twists a loose wire in order to put a bend into the wire so as to consequently decrease the length of the wire between the fence posts and thus increase tension. The installer makes as many bends in the wire as necessary in order to achieve a desired tension.

Wire fence may become damaged by being hit by animals, automobiles or other equipment. Additionally, falling trees brought about by storms may also hit installed wire fence thus causing it to sag. Still further, wire fence may begin to sag over time thus necessitating repair. In these instances, one or more posts of the wire fence may be pushed out of position thus resulting in sagging of the wire connected therewith. In order to repair wire fence it is sometimes the case that the repairer loosens the wire from its attached post and subsequently pulls the wire tight with the use of a lever or winch device. Next, the repairer re-attaches the wire to the post. Such attachment generally involves the use of a hammer to drive a plurality of staples into the post in order to secure the wire thereon.

Current methods of increasing tension in wire fence during installation or repair may result in weakening of the wire. The use of pliers, screwdrivers, or similar devices often results in the creation of one or more 90° bends or other creases in the wire thus creating a weak area that is susceptible to failure. Further, previous methods of creating tension in wire fence often require the use of multiple tools and are labor intensive. As such, there remains room for variation and improvement within the art.

SUMMARY

Various features and advantages of the invention will be set forth in part in the following description, or may be obvious from the description, or may be learned from practice of the invention.

The present invention provides for an apparatus for aiding in the installation and/or repair of wire fence. The apparatus includes a first and second member that are in pivotable engagement with one another. A user may grasp the apparatus and use it to squeeze the wire of a wire fence in order to place a bend therein. Placement of a bend in the wire will cause the overall length of the wire to shorten thus causing an increase in tension of the wire so as to eliminate or reduce sagging.

In accordance with one exemplary embodiment of the present invention, the apparatus includes a first member that has a female portion with a flat recess surface located between a first projection and a second projection. The flat recess surface, first projection and second projection at least partially define a recess. A second member is in pivotable engagement with the first member and has a male portion with a tip. The tip of the male portion is configured to move into and out of the recess of the first member so as to bend the wire of a wire fence therein.

The present invention also provides for an apparatus as immediately discussed in which the tip of the male portion has a curved face.

The present invention also provides for an apparatus as discussed above in which a rivet is used to place the first and second members into pivotable engagement with one another. Further, the first and second projections have the same height which is less than the width of the flat recess surface from the first projection to the second projection.

Also provided for by the present invention is an apparatus for bending wire of a wire fence that has a first member with a female portion. The female portion has a recess surface located between a first projection and a second projection. The recess surface, first projection and second projection at least partially define a recess. A second member is in pivotable engagement with the first member. The second member has a male portion with a tip that has a curved face. The curved face of the tip is configured to move into and out of the recess so as to bed wire of a wire fence therein.

The present invention also provides an apparatus as immediately discussed in which the recess surface of the female portion is flat.

Also provided in accordance with the present invention is an apparatus as discussed above in which the first and second projections of the female portion each have a curved face.

Further, the present invention provides an apparatus as discussed above in which the second member has a hook that is configured for use in removing staples from a fence post.

Additionally provided in accordance with the present invention is an apparatus as discussed above in which the first member has a hammering surface. The hammering surface has a waffle pattern and is configured for use in driving staples into a fence post.

Also included in the present invention is an apparatus as discussed above in which the distance between the first projection and the second projection of the female portion is greater than the width of the tip of the male portion.

The present invention provides for an apparatus as previously discussed in which the first member has a first elongated portion with a first handle that has a plurality of grooves. The first member has an intermediate portion that is disposed between the first elongated portion and the female portion. The second member has a second elongated portion with a second handle that has a plurality of grooves. The second member has a second intermediate portion disposed between the second elongated portion and the male portion. The first intermediate portion is pivotally connected to the second intermediate portion by a rivet.

The present invention also provides an apparatus for bending wire of a wire fence. The apparatus includes a first member that has a first elongated portion with a first handle. The first member has a first intermediate portion disposed between the first elongated portion and a female portion. The female portion has a flat recess surface located between a first projection and a second projection. The flat recess surface, first projection and second projection at least partially define a recess. The first and second projections each have a curved face. A second member is in pivotable engagement with the first member. The second member has a second elongated portion that has a second handle. The second member has a second intermediate portion disposed between the second elongated portion and a male portion. The male portion has a tip with a curved face. The curved face of the tip is configured for being moved into and out of the recess of the first member so as to bend wire of a wire fence therein.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended FIGS. in which.

Figure 1:
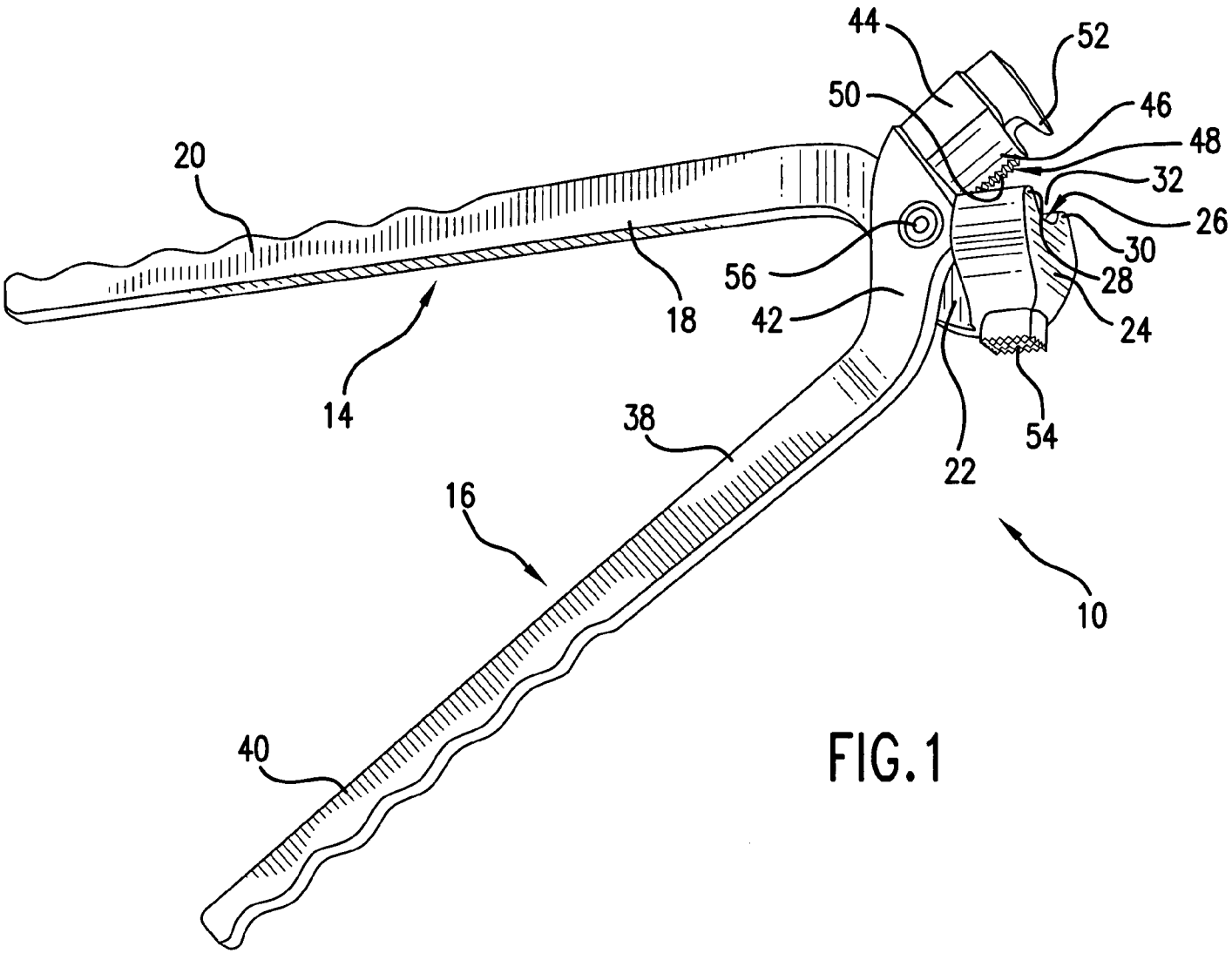
FIG. 1 is a perspective view of an apparatus for placing a bend into wire of a wire fence in accordance with one exemplary embodiment of the present invention.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to about 7 also includes a limit of up to about 5, up to about 3, and up to about 4.5.

The present invention provides for an apparatus 10 that is used to form a bend in the wire 58 of a wire fence 12 in order to shorten the length of the wire 58 so as to reduce sagging. The apparatus 10 is a hand-held device that includes a first member 14 and a second member 16 that act in combination to place a bend into the wire 58. The apparatus 10 bends the wire 58 in such a way so that the strength of the wire 58 is either maintained or only slightly reduced. The apparatus 10 can be used during installation or repair of the wire fence 12.

One exemplary embodiment of the present invention is shown in FIG. 1. The apparatus 10 includes a first member 14 and a second member 16 that are pivotally connected to one another by a rivet 56. The rivet 56 may be provided so that the pivotal connection between members 14 and 16 exhibits any desired degree of tightness. The first and second members 14 and 16 include a female portion 24 and a male portion 44 that are urged towards and away from one another during pivoting of the apparatus 10. As will be explained below, the apparatus 10 is positioned so that wire 58 is placed into contact with the female and male portions 24 and 44 and bent thereby through application of force by a user on the apparatus 10.

Figure 2:
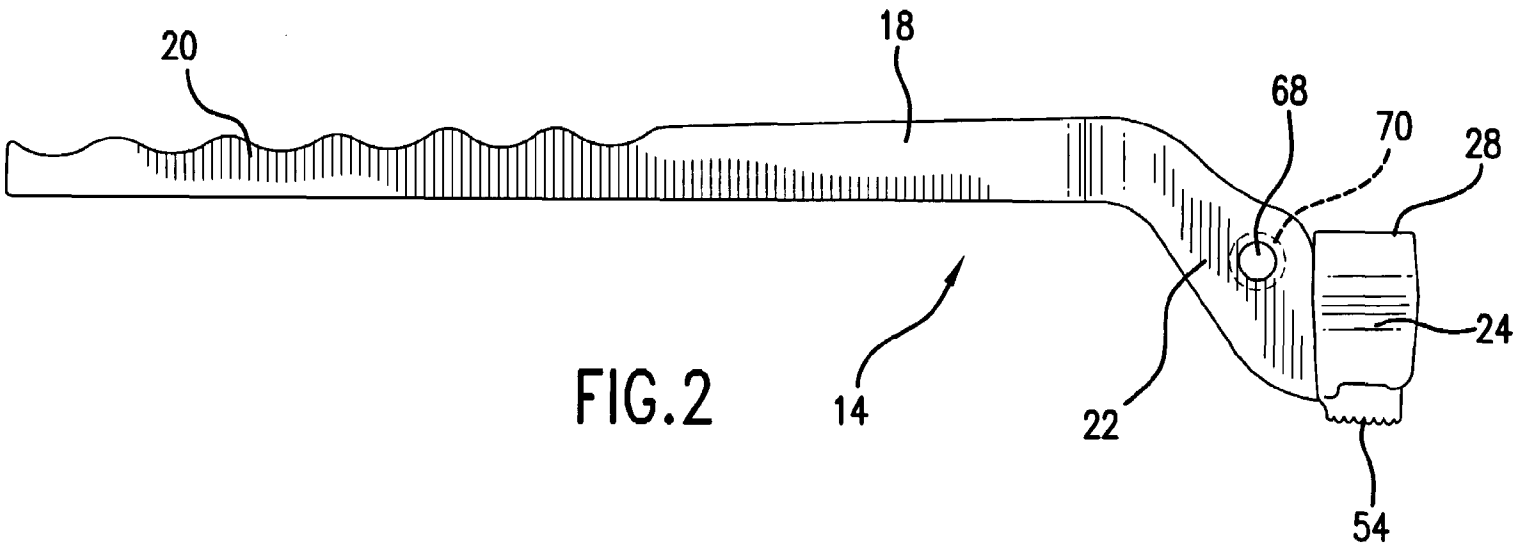
FIG. 2 is a side view of a first member of the apparatus of FIG. 1.

FIG. 2 is a side view of the first member 14. The first member 14 has a first elongated portion 18 that has a first handle 20. The first handle 20 may have a plurality of grooves defined thereon in order to aid a user of the apparatus 10 in grasping the first member 14. However, it is to be understood that in accordance with other exemplary embodiments of the present invention that the first handle 20 need not include grooves thereon. Additionally, other configurations of the first handle 20 are possible. For instance, the first handle 20 may be a rubber sleeve, which has a high coefficient of friction for gripping purposes, placed over the end of the first elongated portion 18.

A first intermediate portion 22 is adjacent to the first elongated portion 18. The first intermediate portion 22 may be offset from the first elongated portion 18 so that these two portions may have faces that are in offset planes to one another. The offset relationship may be made by a curved section of the first intermediate portion 22 and/or the first elongated portion 18 so that the first intermediate portion 22 is recessed with respect to the first elongated portion 18 as viewed in FIG. 2. A hole 68 is defined in the first intermediate portion 22 and extends completely through the thickness thereof. A taper 70 is included on the side of the first intermediate portion 22 not visible in FIG. 2. The hole 68 and taper 70 may be provided for use in placing and securing the rivet 56.

The female portion 24 is adjacent the first intermediate portion 22. The first elongated portion 18, first intermediate portion 22, and female portion 24 may be formed as one single, integral piece. In accordance with one embodiment, the portions 18, 22 and 24 are formed as one integral piece by a casting process. Alternatively, one or more of the portions 18, 22 or 24 may be a separate portion that is attached to the others in accordance with other exemplary embodiments. The portions 18, 22 and 24 may be made out of any suitable material. For example, the portions 18, 22 and 24 may be made out of steel, aluminum, and/or iron in various embodiments. The female portion 24 may be wider than the first elongated portion 18 and the first intermediate portion 22 as may be more clearly seen in FIG. 1. The increased width of the female portion 24 may allow for a more desirable bending of the wire 58 as will be later discussed.

Figure 3:
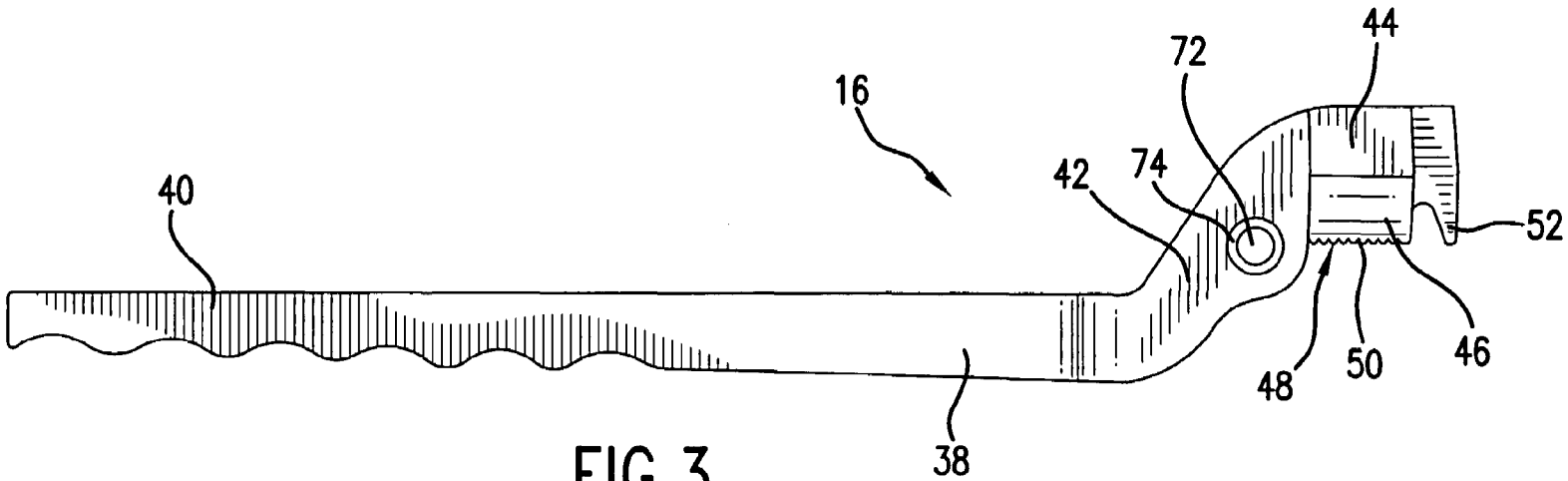
FIG. 3 is a side view of a second member of the apparatus of FIG. 1.

FIG. 3 is a side view of the second member 16. The second member 16 includes a second elongated portion 38 that has a second handle 40. The second handle 40 has a plurality of grooves defined thereon in order to aid in gripping of the handle 40 by a user. However, as previously discussed with respect to the first handle 20 the second handle 40 need not have grooves and may be variously configured in accordance with other exemplary embodiments. The first and second handles 20 and 40 may be configured in the same manner or may be configured in different manners in other embodiments. For example, in accordance with one exemplary embodiment, the second handle 40 has a plurality of grooves thereon for receiving the fingers of the user, while the first handle 20 defines a single depression thereon for receiving the palm of the user.

A second intermediate portion 42 is also included in the second member 16. The second intermediate portion 42 is adjacent the second elongated portion 38 and may have a face that is offset from a face of the second elongated portion 38. In this regard, the visible face of the second intermediate portion 42 in FIG. 3 is closer to the viewer than the visible face of the second elongated portion 38. A curved section of the second elongated portion 38 and/or the second intermediate portion 42 may be provided to achieve the aforementioned offset. FIG. 1 shows the offsetting of the first elongated portion 18 and the first intermediate portion 22 of the first member 14 and the offsetting of the second elongated portion 38 and the second intermediate portion 42 of the second member 16. The offsetting arrangement enables the first and second intermediate portions 22 and 42 to pivot with respect to one another while allowing the first and second elongated portions 18 and 38 to have faces that are in the same plane as one another. In this manner, the handles 20 and 40 are not required to be offset from one another which may aid in grasping of the apparatus 10 and allow for easier use. However, it is to be understood that in accordance with other exemplary embodiments that the offsetting arrangement need not be present. In this regard, the handles 20 and 40 may have planar faces that are offset from one another, or alternatively the handles 20 and 40 may have planer faces that are not offset while a different pivoting arrangement from the one illustrated is employed.

As shown in FIG. 3, the second intermediate portion 42 has a hole 72 with a taper 74. The face of the second intermediate portion 42 opposite from the one shown in FIG. 3 does not have a taper. In this regard, the non-tapered faces of the first and second intermediate portions 22 and 42 face one another while the tapered faces of the first and second intermediate portions 22 and 42 are located on the outside of the apparatus 10. The tapers 70 and 74 are present to aid in securing the rivet 56 so as to establish pivotable engagement of the first member 14 and second member 16.

The male portion 44 is adjacent the second intermediate portion 42. The portions 38, 42 and 44 may be formed as a single, integral piece or may be multiple pieces that are attached to one another. In one exemplary embodiment, the portions 38, 42 and 44 are formed as a single piece through a casting process. The portions 38, 42 and 44 may be made out of any suitable material. For example, the portions 38, 42 and 44 may be made out of steel, aluminum, and/or iron. In accordance with another exemplary embodiment, the second elongated portion 38 and the second intermediate portion 42 are formed as a single piece through a casting process while the male portion 44 is a separate piece that is attached to the second intermediate portion 42 through welding.

Figure 4:
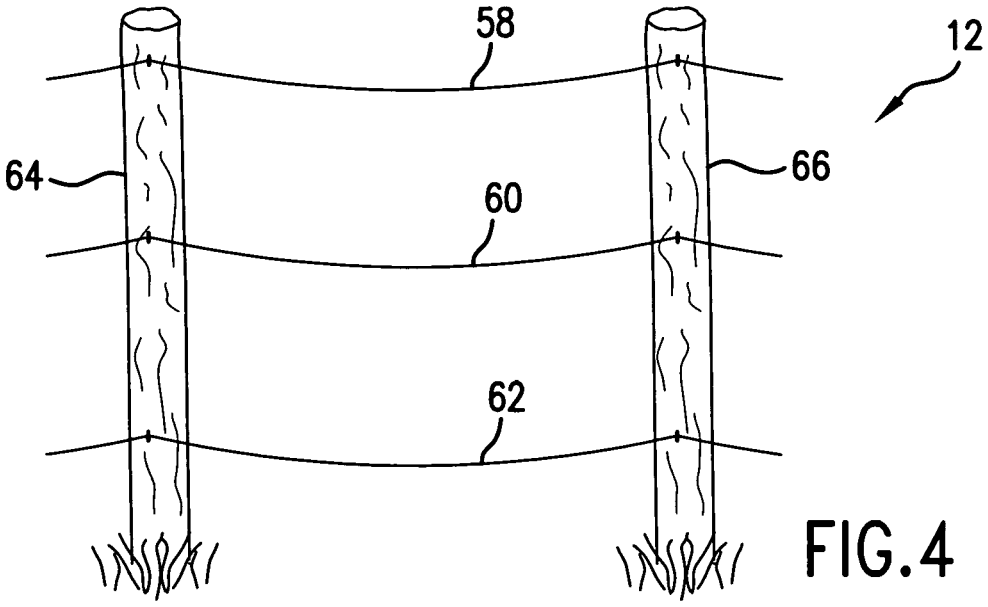
FIG. 4 is a side view of a wire fence that has three wires that are sagging between a pair of fence posts.

As previously mentioned, the apparatus 10 is used to place a bend into the wire 58 in order to shorten the length of the wire 58 and hence increase tension to reduce sagging or otherwise achieve a more desirable positioning of the wire 58. FIG. 4 shows a wire fence 12 that includes a pair of posts 64 and 66 that are spaced from one another. The wire fence 12 has three wires 58, 60 and 62 that are attached to both posts 64 and 66. The wires 58, 60 and 62 may either end at the posts 64 and 66 or may continue onto other posts in the wire fence 12 as is commonly known in the art. As shown, the wires 58, 60 and 62 exhibit some degree of sagging. The sagging may be brought about by a number of factors. For example, too great a length of the wires 58, 60 and 62 may have been used when installing onto posts 64 and 66. As previously mentioned installation of the wire fence 12 up or down a hill may cause certain ones of the wires 58, 60 or 62 to sag and others to be tight depending upon the direction of installation. Additionally or alternatively, one of the posts 64 or 66 could have been hit by a car, animal or other object and knocked out of place thus resulting in sagging of the wires 58, 60 and 62. Further, an object may have fallen on the wires 58, 60 and 62 to cause them to sag, or the sagging may occur though a variety of other reasons.

Figure 5:
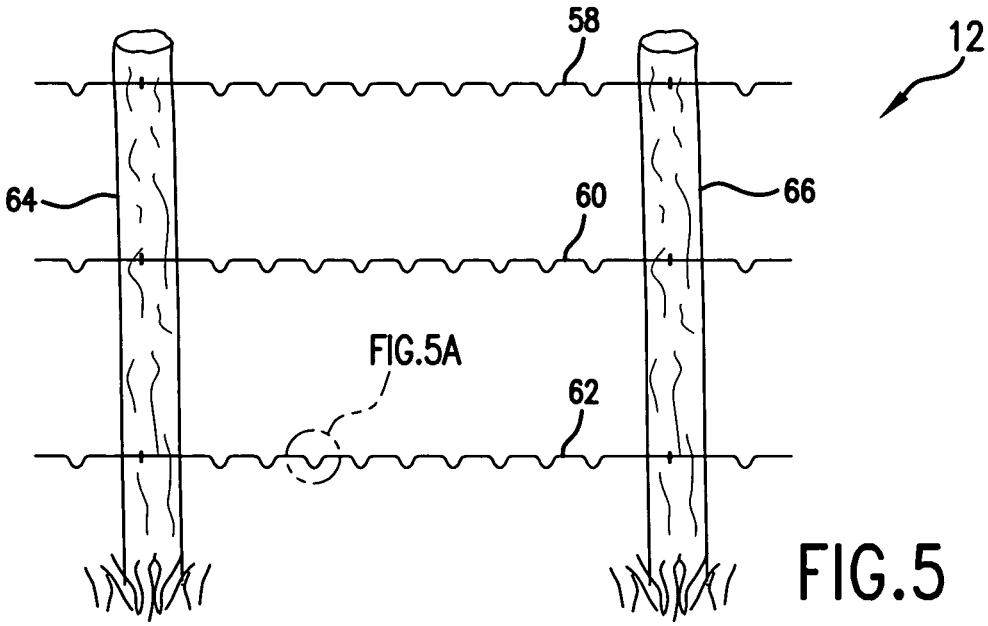
FIG. 5 is a side view of the wire fence of FIG. 4 after a plurality of bends have been placed into the wires in order to increase tension thereof and hence decrease sagging.
Figure 6:
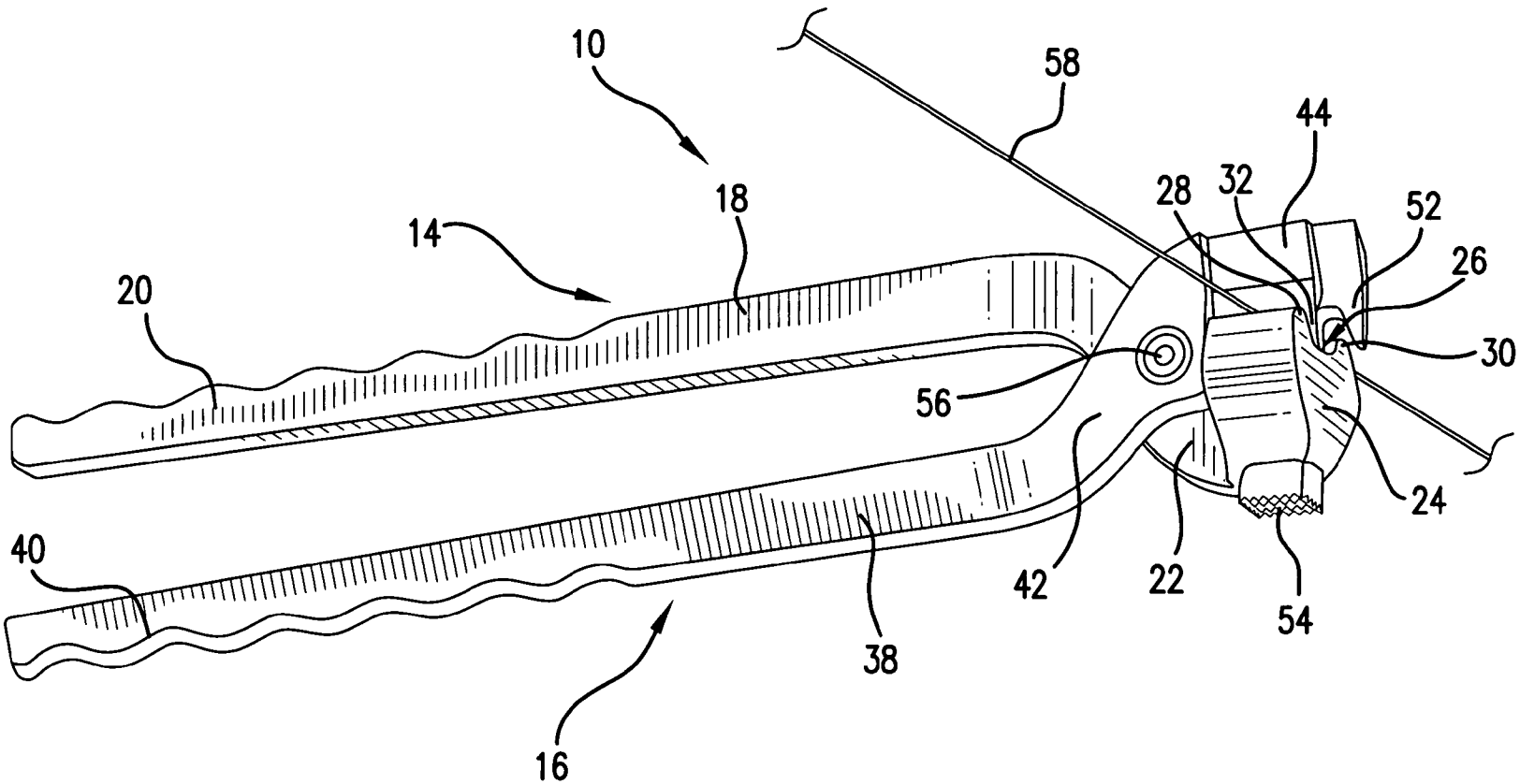
FIG. 6 is a perspective view of an apparatus in accordance with one exemplary embodiment of the present invention shown placing a bend into wire of a wire fence.

FIG. 5 shows the wire fence 12 of FIG. 4 after a plurality of bends are put into the wires 58, 60 and 62 by the apparatus 10. As shown, the tension of the wires 58, 60 and 62 is increased thus eliminating sagging therein and achieving a more desirable positioning of the wires 58, 60 and 62 with respect to the posts 64 and 66. FIG. 6 shows the apparatus 10 in the process of bending the wire 58. The apparatus 10 is first opened by pivoting the first member 14 with respect to the second member 16 so that the female portion 24 and the male portion 44 are spaced from one another to allow the wire 58 to be positioned in between. Next, the user may grasp the handles 20 and 40 and apply force to the members 14 and 16 in order to clamp the wire 58 between the female portion 24 and the male portion 44 so as to effect bending thereof. The length of the elongated portions 18 and 38 may be selected so that a desirable mechanical advantage is realized upon pivoting the first and second members 14 and 16 about the rivet 56 that acts as the pivot point in the exemplary embodiment shown. In this regard, the length of the female portion 24 and male portion 44 from the rivet 56 is less than the length of the handles 20 and 40 from the rivet 56 so that it is easier for the user to grasp the apparatus 10 and apply a necessary force to the wire 56. In accordance with several different embodiments, the first and second members 14 and 16 may have a length of up to 12 inches from the rivet 56 to the end of the first and second members 14 and 16 proximate to the handles 20 and 40.

Figure 5A:
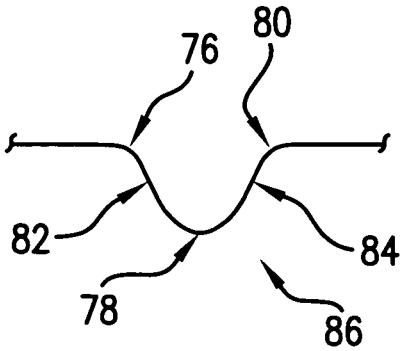
FIG. 5A is a detail view as denoted by the circle in FIG. 5.

As shown more clearly in the detail view of FIG. 5A, placement of the wire 58 between the female portion 24 and male portion 44 and clamping therein causes a bend 86 to be formed therein. The bend 86 has a first curved section 76 that curves in a direction opposite to that of a second curved section 78. A third curved section 80 is also present and curves in the same direction as the first curved section 76. The second curved section 78 is located between the first and third curved sections 76 and 80. A first straight section 82 is located between the first and second curved sections 76 and 78. Additionally, a second straight section 84 is located between the second and third curved sections 78 and 80. It is to be understood that the bend 86 shown is formed in accordance with only one exemplary embodiment of the present invention and that others are possible. For example, the bend 86 may be made so that the first and second straight sections 82 and 84 are not present. In this embodiment, the entire length of the wire 58 in the bend 86 may be formed so that all portions are curved. Alternatively, the bend 86 may be made so that only one of the straight sections 82 or 84 is present.

The bend 86 made in the wire 58 is placed so that the second curved section 78 opens upwards. As shown, all of the bends in the wire 58 are made in a similar manner. Additionally, the bends made in wire 60 are also made in the same way as those in wire 58 and are oriented so that the second curved section 78 opens upwards. Wire 62, on the other hand, includes bends in which the second curved section 78 opens downwards. The bends put into wires 58, 60 and 62 may be oriented in any desirable manner, and it is to be understood that the orientations shown in FIG. 5 are only one possibility. For example, a number of bends may be placed into wire 58 in which the second curved section 78 opens upwards in addition to a number of bends in wire 58 in which the second curved section opens downwards. Still further, bends may be placed into all of the wires 58, 60 and 62 in which the second curved section 78 opens in the same direction.

The number of bends put into the wires 58, 60 and 62 may be selected so that any desired degree of tension is achieved. As such, the number of bends in wires 58, 60 and 62 may be different depending upon the amount of sagging in the wires 58, 60 and 62. Although shown for use with a wire fence 12 that has only generally horizontally extending wires 58, 60 and 62, it is to be understood that the apparatus 10 may be used with wire fence 12 that is variously configured. For example, the apparatus 10 may be used with wire fence 12 that is woven. This type of wire fence 12 has generally vertically extending wires that engage the generally horizontally extending wires so as to form a grid-like pattern. The apparatus 10 may be configured to bend wire 58 that is 9 gauge or less in certain embodiments. The apparatus 10 may be used to put bends into the generally vertically extending wires in order to increase their tension. It is to be understood that the apparatus 10 may be used to put bends into other types of wire fence 12 from the one shown, and that the wire fence 12 shown in FIGS. 4 and 5 is only one example.

Figure 7:
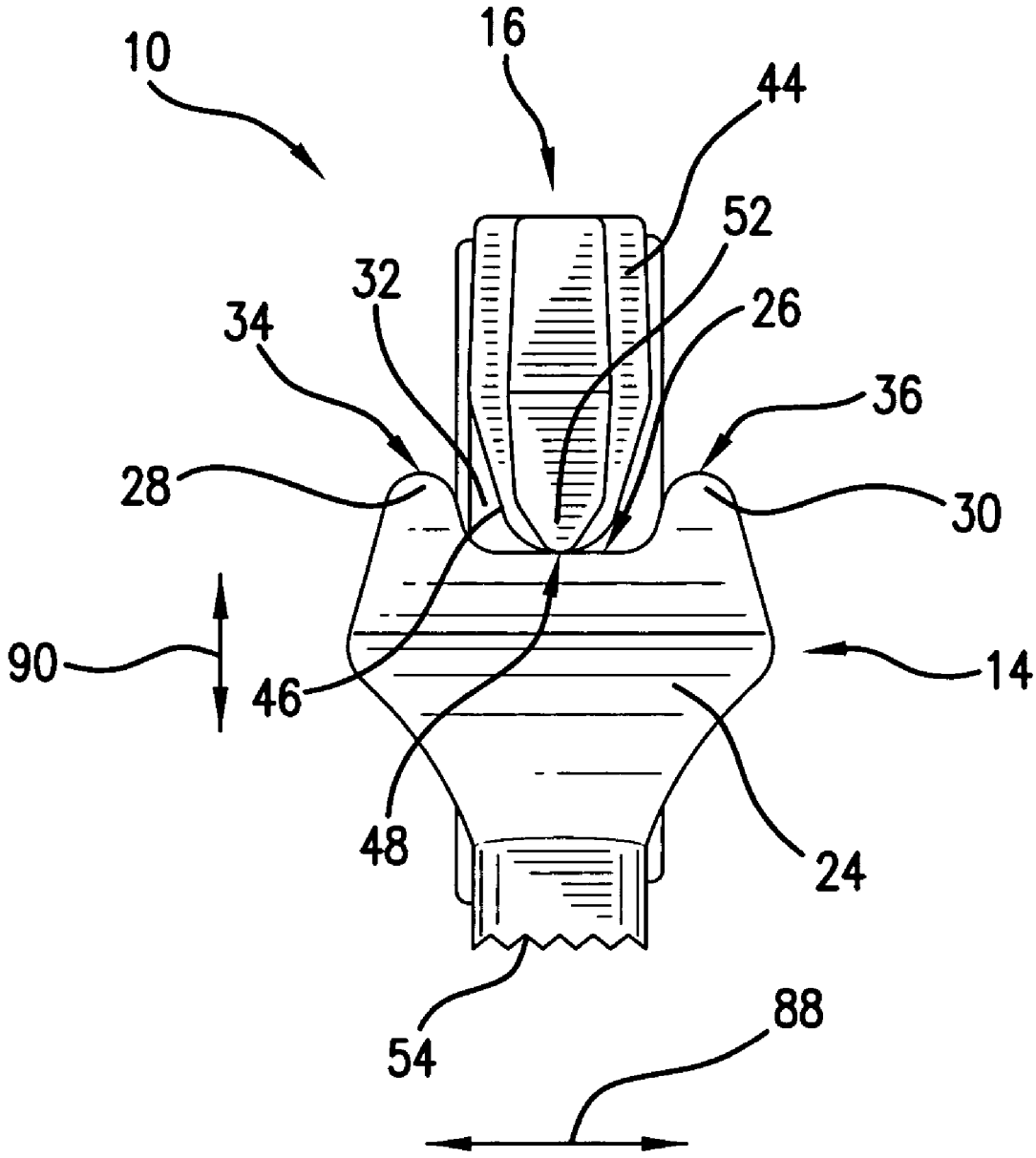
FIG. 7 is a top view of an apparatus in accordance with one exemplary embodiment of the present invention shown in the closed position.

FIG. 7 shows a top view of the apparatus 10 in which the female portion 24 and the male portion 44 are moved into contact with one another. As may be seen upon viewing FIGS. 1 and 7, the female portion 24 defines a recess 32. The recess 32 is at least partially defined by a recess surface 26 of the female portion 24. The recess surface 26 may be a flat surface in certain exemplary embodiments. Alternatively, the recess surface 26 may have a number of grooves or projections defined thereon for use in gripping the wire 58 during bending. Additionally or alternatively, the grooves or projections of the recess surface 26 may be used for forming a bend with a desired shape in the wire 58. The female portion 24 also includes a first projection 28 and a second projection 30 that also at least partially define the recess 32. The recess surface 26 may be located so as to be between the first projection 28 and the second projection 30 in a direction 88 that may be designated as the width direction of the apparatus 10. The first projection 28 and the second projection 30 extend in the same direction beyond the recess surface 26 in a direction 90 that may be designated as the height direction of the apparatus 10.

The female portion 24 may be configured so that the height of the first and second projections 28 and 30 is less than the width of the recess surface 26. In this regard, the height of the first and second projections 28 and 30 is the distance in direction 90 from the top of the projections 28 and 30 to the recess surface 26. Also, the width of the recess surface 26 is the distance in direction 88 of the recess surface 26 between the projections 28 and 30. The size relationship between the projections 28 and 30 and the recess surface 26 may allow for a desirable bending of the wire 58 so that strength is maintained or not significantly reduced. However, it is to be understood that other exemplary embodiments are present in which different size relationships exist between the projections 28 and 30 and the recess surface 26.

The first projection 28 has a curved face 34 and the second projection 30 has a curved face 36. The curved faces 34 and 36 may allow for a desired bending of the wire 58 so that strength is either maintained or not significantly reduced. In this regard, the curved face 34 may be provided so that the first curved section 76, as shown in FIG. 5, is formed in a desired shape. Likewise, the curved face 36 may be provided so that the third curved section 80 is shaped as desired. The radius of curvature of the curved faces 34 and 36 may be identical to one another or may be different. Further, it is to be understood that in other exemplary embodiments that one or both of the curved faces 34, 36 need not be present. In this regard, the first and second projections 28 and 30 may have a corner facing the recess 32 that is a right angle. The first and second projections 28 and 30 may be variously shaped in accordance with other exemplary embodiments. For example, the projections 28 and 30 in one embodiment are triangular shaped.

The male portion 44 includes a tip 46. The tip 46 may be positioned into the recess 32 upon pivotal movement of the first and second members 14 and 16. In alternative embodiments, the tip 46 may be always located in the recess 32 but moved towards the recess surface 26 upon pivotal movement of members 14 and 16. The wire 58 may be positioned between the recess surface 26 and the tip 46 and the apparatus 10 may be manipulated so that the recess surface 26 and tip 46 are moved towards one another. This action causes the wire 58 to be bent between the recess surface 26 and tip 46 thus forming a desired bend of the wire 58. The tip 46 has a curved face 48 that may be provided in order to make the second curved section 78 of the wire 58 as shown in FIG. 5. However, it is to be understood that the tip 46 need not have a curved face 48 in other embodiments. For instance, the tip 46 may be have a flat face or may be pointed. The curved face 48 of tip 46 may have a plurality of grooves 50 thereon to aid in gripping the wire 58 during bending so as to reduce the chance of having the wire 58 slip when force is applied thereto. The grooves 50 are shown more clearly in FIG. 3.

Referring back to FIG. 7, the width of the recess surface 26 may be selected so that it is larger than the width of the tip 46. In this regard the width of the tip 46 is measured in direction 88. The width of the recess surface 26 is measured in the direction 88 between the points at which the first and second projections 28 and 30 begin to curve upwards from the recess surface 26 in direction 90. In alternative embodiments, the width of the tip 46, again as measured in direction 88, is less than the distance between the highest points of the first and second projections 28 and 30. When discussing the width of the tip 46, this property is measured as the largest distance of the tip 46 in direction 88 that can be placed into the recess 32 in the area of apparatus 10 in which bending occurs.

As shown more clearly in FIG. 3, the male portion 44 includes a hook 52. The hook 52 is located at the top of the male portion 44 and is positioned so that it is not received within the recess 32 upon closing the apparatus 10. The hook 52 may be used to aid in the removal of staples from posts 64 and 66. Staples are sometimes used in order to attach wire 58 to posts 64 and 66 and subject for removal during installation or repair of the wire fence 12. The hook 52 is located at the end of the apparatus 10 so that a desirable mechanical advantage may be obtained upon working the hook 52 under a staple and then pivoting the apparatus to effect removal. It is to be understood, however, that the hook 52 may be located at other spots on the apparatus 10 and need not be present in other embodiments. The hook 52 may have a length from 0.125 inches to 1 inch in accordance with various exemplary embodiments of the present invention.

The female portion 24 has a hammering surface 54 as may be seen in FIGS. 1 and 2. The hammering surface 54 is present on a projection that is located on the side of female portion 24 opposite from the recess surface 26. The hammering surface 54 may be flat, or may include a waffle pattern as shown. In this regard, the waffle pattern is formed by a series of small projections located next to one another so as to form a grid-like design. The hammering surface 54 may be used by a user of the apparatus 10 for driving nails or staples into posts 64 and 66. In this regard, the user may grasp the handles 20 and 40 and swing the apparatus 10 so that the hammering surface 54 strikes a nail or staple that is used for holding wire 58 onto one of the posts 64 or 66. The hammering surface 54 may be located on an end of the apparatus 10 so that a larger amount of force is transmitted upon striking. However, the hammering surface 54 may be located at other spots in various embodiments.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. An apparatus for bending wire of a wire fence, comprising:

a first member that has a female portion, wherein said female portion has a flat recess surface located between a first projection and a second projection, wherein said flat recess surface and said first projection and said second projection at least partially define a recess, wherein said first projection and said second projection of said female portion each have a curved face; and a second member in pivotable engagement with said first member, wherein said second member has a male portion with a tip that has a curved convex face, and wherein said curved convex face of said tip of said male portion is configured to move into and out of said recess of said first member so as to bend wire of a wire fence therein;

wherein said curved face of said tip defines a plurality of grooves.

2. The apparatus as in claim 1, wherein said second member has a hook configured for use in removing staples from a fence post.

3. The apparatus as in claim 1, wherein the distance between said first projection and said second projection of said female portion is greater than the width of said tip of said male portion.

4. The apparatus as in claim 1, wherein said first member has a first elongated portion with a first handle that has a plurality of grooves defined thereon, and wherein said first member has a first intermediate portion disposed between said first elongated portion and said female portion;

wherein said second member has a second elongated portion with a second handle that has a plurality of grooves defined thereon, and wherein said second member has a second intermediate portion disposed between said second elongated portion and said male portion; and wherein said first intermediate portion is pivotally connected to said second intermediate portion by a rivet.

5. An apparatus for bending wire of a wire fence, comprising:

a first member that has a female portion, wherein said female portion has a flat recess surface located between a first projection and a second projection, wherein said flat recess surface and said first projection and said second projection at least partially define a recess, wherein said first projection and said second projection of said female portion each have a curved face; and a second member in pivotable engagement with said first member, wherein said second member has a male portion with a tip that has a curved convex face, and wherein said curved convex face of said tip of said male portion is configured to move into and out of said recess of said first member so as to bend wire of a wire fence therein;

wherein said first member has a hammering surface configured for use in driving staples into a fence post, and wherein said hammering surface has a waffle pattern.

6. The apparatus as in claim 5, further comprising a rivet used to place said first member and said second member into pivotable engagement with one another; and wherein said first and second projections have the same height, and wherein the height of said first and second projections from said flat recess surface is less than the width of said flat recess surface from said first projection to said second projection.

7. An apparatus for bending wire of a wire fence, comprising:

a first member that has a female portion, wherein said female portion has a recess surface located between a first projection and a second projection, wherein said recess surface and said first projection and said second projection at least partially define a recess, wherein said first and second projections have the same height from said recess surface, and wherein the height of said first projection and said second projection is less than the width of said recess surface between said first projection and said second projection; and a second member in pivotable engagement with said first member, wherein said second member has a male portion with a tip that has a curved face, and wherein said curved face of said tip is configured to move into and out of said recess of said first member so as to bend wire of a wire fence therein.

8. The apparatus as in claim 7, wherein said recess surface of said female portion is flat.

9. The apparatus as in claim 7, wherein said first projection and said second projection of said female portion each have a curved face.

10. The apparatus as in claim 7, wherein said curved face of said tip defines a plurality of grooves.

11. The apparatus as in claim 7, wherein said second member has a hook configured for use in removing staples from a fence post.

12. The apparatus as in claim 7, wherein said first member has a hammering surface configured for use in driving staples into a fence post, and wherein said hammering surface has a waffle pattern.

13. The apparatus as in claim 7, wherein the distance between said first projection and said second projection of said female portion is greater than the width of said tip of said male portion.

14. The apparatus as in claim 7, further comprising a rivet used to place said first member and said second member into pivotable engagement with one another.

15. The apparatus as in claim 7, wherein said first member has a first elongated portion with a first handle that has a plurality of grooves defined thereon, and wherein said first member has a first intermediate portion disposed between said first elongated portion and said female portion;

wherein said second member has a second elongated portion with a second handle that has a plurality of grooves defined thereon, and wherein said second member has a second intermediate portion disposed between said second elongated portion and said male portion; and wherein said first intermediate portion is pivotally connected to said second intermediate portion by a rivet.

* * * * *